US005148951A

United States Patent [19]

Moure et al.

[11] Patent Number: 5,148,951

[45] Date of Patent: Sep. 22, 1992

[54] CONTAINER WITH FLEXIBLE RESILIENT DISPENSING SHEET FOR VISCOUS AND SEMI-SOLID CLEANING COMPOSITIONS

[75] Inventors: Juan C. V. Moure, Miranda; Juan C. R. R. Ramos, Caracas, both of Venezuela

[73] Assignee: The Procter & Gamble Company, Cincinnati, Ohio

[21] Appl. No.: 616,537

[22] Filed: Nov. 21, 1990

[51] Int. Cl.[5] ..... B67D 5/06

[52] U.S. Cl. ..... 222/386; 15/257.05; 100/116; 118/264; 222/405; 425/84

[58] Field of Search ..... 222/386, 405; 100/116; 118/264, 270; 220/216, 227; 425/84, 85; 215/231; 15/257.05

[56] References Cited

U.S. PATENT DOCUMENTS

| | | | |
|---|---|---|---|
| 522,693 | 7/1894 | McLaughlin | 222/405 X |
| 557,014 | 3/1896 | Osgood | 15/257.05 |
| 1,065,823 | 6/1913 | Matthews | 15/257.05 |
| 1,375,938 | 4/1921 | Slack | 401/130 |
| 1,558,407 | 10/1925 | Sommer | 223/130 |
| 1,608,449 | 11/1926 | Wendel | 223/130 |
| 1,942,248 | 7/1934 | Kemp | 222/390 X |
| 1,943,647 | 1/1934 | Weller | 401/126 |
| 2,568,814 | 9/1951 | Marcellus | 401/126 |
| 2,601,940 | 7/1952 | Marcellus | 222/405 |
| 2,628,743 | 2/1953 | Newlyn | 222/405 |
| 2,763,405 | 9/1956 | Shvetz | 222/320 |
| 2,939,162 | 6/1960 | Kravitt | 15/257.05 |
| 2,994,901 | 8/1961 | Ely | 15/257.05 |
| 4,020,523 | 5/1977 | Brown | 15/257.05 |
| 4,506,784 | 3/1985 | Kanfer | 206/77.1 |
| 4,752,147 | 6/1988 | Persi | 401/126 |
| 4,831,681 | 5/1989 | Puder | 15/257.05 |
| 4,948,078 | 8/1990 | Dumenigo | 248/176 |
| 4,991,500 | 2/1991 | Knapp | 100/240 X |

FOREIGN PATENT DOCUMENTS

| | | | |
|---|---|---|---|
| 547411 | 10/1957 | Canada | 222/386 |
| 40564 | 8/1929 | Denmark | 222/386 |
| 2656907 | 7/1977 | Fed. Rep. of Germany | 425/84 |
| 8516914 | 7/1985 | Fed. Rep. of Germany . | |
| 3605422 | 8/1987 | Fed. Rep. of Germany | 222/386 |
| 1271799 | 8/1961 | France . | |

OTHER PUBLICATIONS

International Search Report under the Patent Cooperation Treaty, mailed Apr. 28, 1992.

*Primary Examiner*—Michael S. Huppert
*Assistant Examiner*—Joseph A. Kaufman
*Attorney, Agent, or Firm*—Daniel F. Nesbitt; Gary M. Sutter; Richard C. Witte

[57] ABSTRACT

A dispensing package for gel and semi-solid cleaning and skin care compositions. The package comprises a container for the product and a dispensing sheet that rests on and adheres to the surface of the product. Optionally, a lid for the container is provided. The dispensing sheet is provided with apertures through which the product flows when pressure is applied to the dispensing sheet. The dispensing sheet preferably has apertures along its edge which define petals. The dispensing sheet controls the quantity of product dispensed onto the fingers or a sponge, thereby providing decreased mess and product waste, along with improved aesthetics. The package is particularly useful for gel dishwashing products.

5 Claims, 4 Drawing Sheets

CONTAINER WITH FLEXIBLE RESILIENT DISPENSING SHEET FOR VISCOUS AND SEMI-SOLID CLEANING COMPOSITIONS

FIELD OF THE INVENTION

The present invention relates to packages for containing and dispensing viscous and semi-solid products, such as compositions for hard surface cleaning, dishwashing, and personal cleansing and cream and lotion skin care products. The invention also relates to an improvement in the method of dispensing these products from their package or container.

BACKGROUND OF THE INVENTION

Cleaning and skin care products are used commonly and often are in the form of viscous and semi-solid compositions such as gels, pastes, cream, and lotions. Such cleaning and skin care products and compositions (hereinafter such viscous and semi-solid compositions are generally referred to as "gel compositions") can be packaged in containers having a variety of shapes, such as cylinders, bowls, rectangles, triangles, squares, and others, with snap-on friction or hinged lids. In conventional use, the lid is removed from the product container and the user dips into the gel composition either directly with the fingers or with an implement such as a sponge, dish cloth or face cloth (hereinafter simply referred to as "sponge"). The gel composition which adheres to or is extracted by the fingers or sponge is then mixed with water to form a wash solution or, more commonly, it is applied directly to the surface to be cleaned, whether it be a hard surface such as dishware or to one's body. Although this conventional method for dispensing the composition from the container is effective, it does not address or solve all of the difficulties associated with dispensing gel compositions from such conventional containers. For example, it is quite difficult to control the amount of composition that is taken from the container on the fingers or the sponge when dipping directly into the gel composition in an open container. This can lead to excessive use or waste of the gel composition. Also, in dishwashing applications, loose food particles in the gel composition, which can adhere to the sponge and can slough off into the dishwashing gel when the user reaches back into the container for additional gel, are aesthetically undesirable and are very difficult then to extract from the gel. Further, a gel composition in a conventional container or package can smear onto the inside surface of the lid during shipment and handling of the product, which can make subsequent handling of the lid during product use both messy and aesthetically unacceptable. Another difficulty with conventional packages and with the conventional dispensing method is the tendency for the wet sponge, if placed after use onto the surface of the gel composition in the container, to sink into the gel and to become excessively adhered thereto, which results in difficulty in extracting the sponge and product waste during the next use.

The present invention significantly reduces or eliminates these difficulties in dispensing gel compositions from their containers.

SUMMARY OF THE INVENTION

The present invention is an improved dispensing package for a gel composition which comprises a container provided with an opening and a dispensing sheet which is provided with a plurality of apertures and which rests on the surface of a gel composition inside the container. The package can optionally include a lid to cover the opening in the container. The shape of the dispensing sheet conforms substantially to the shape of the container. The invention also relates to an improved method of dispensing the gel composition from the container through the apertured dispensing sheet to control the quantity of gel removed from the container in use, and to improve the aesthetics of the product in use.

DETAILED DESCRIPTION OF INVENTION

As used hereinafter, all composition percentages and ratios are by weight.

The Container

Figure 1:
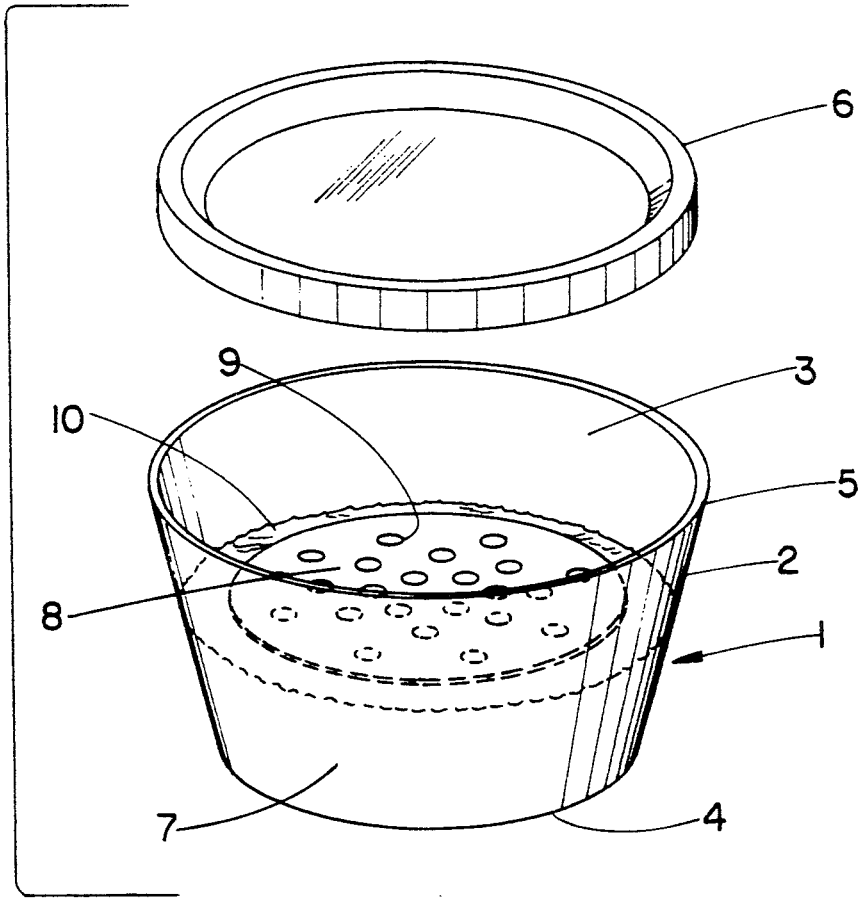
FIG. 1 shows a container of the present invention with a dispensing sheet.
Figure 5:
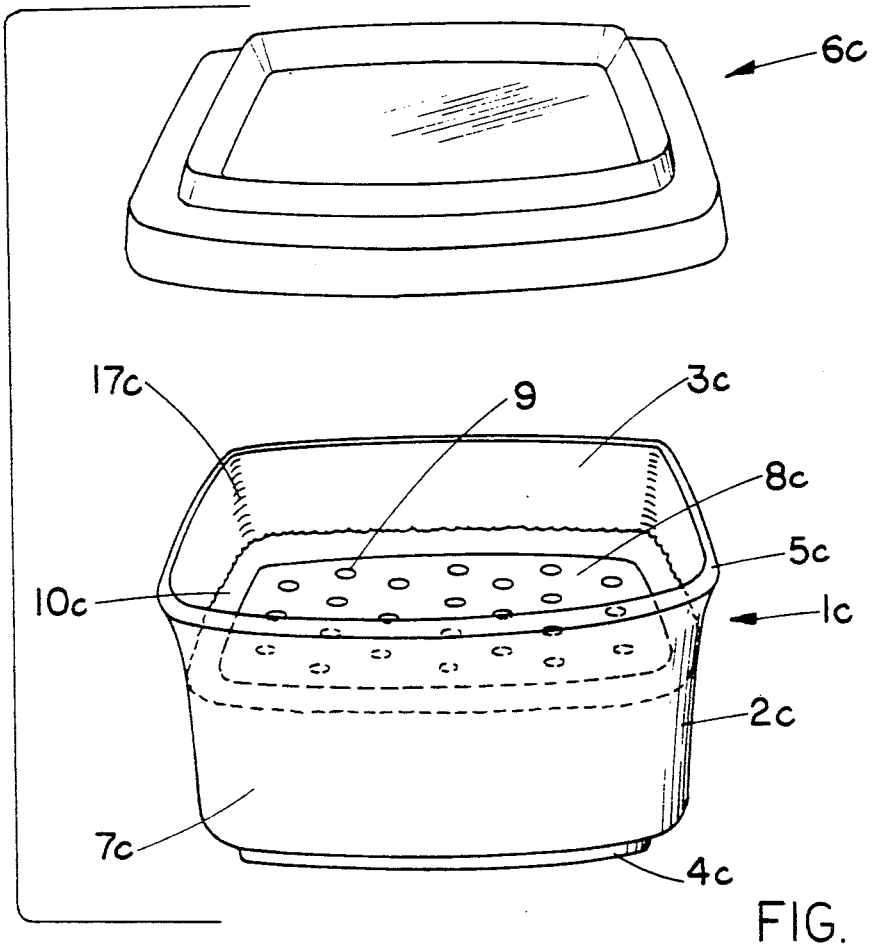
FIG. 5 shows another embodiment of a container with a dispensing sheet.

FIG. 1 shows a bowl-shaped container 1 with a slightly tapered sidewall 2, such that the opening 3 has a diameter which is greater than the interior diameter of the bottom 4 of the container 1. The container 1 can also have substantially vertical sidewalls 2 such that the size and shape of the top opening 3 and of the bottom 4 of the container are substantially identical. A container 1*c* of the present invention can also have a substantially rectangular shape as shown in FIG. 5, which can have sidewalls 2*c* which are substantially perpendicular to the bottom 4*c*. The sidewalls of a container of the present invention can be tapered outwardly or inwardly, so long as the package functions substantially as described hereinafter. A "substantially rectangular" container 1*c*, which can include a square shape, preferably has rounded corners 17*c* to facilitate easy and complete removal of gel composition from the container. In general container 1 of the present invention can be any shape and size, such as a triangle, oval, and ellipsoid, so long as the shape and size permits one to practice the invention substantially as herein described. The container must also have an opening 3 that is large enough to accommodate the fingers or an implement, and must not be so tall that it is difficult to reach the last amounts of gel composition from the bottom 4 of the container 1 with the fingers or implement.

The container 1 of the present invention is preferably one which has an opening 3 having a diameter or a minimum dimension which is greater than the height (the distance between the plane of the opening 3 and the plane of the bottom 4 of the container) of the container 1. The ratio of the diameter or the minimum dimension of the opening 3 to the height of the container 1 is preferably from about 0.5:1 to about 5:1, more preferably from about 1.5:1 to about 3:1.

The container 1 of the present invention can have a bottom of any type, so long as the shape of the bottom 4 does not interfere with removal of substantially all of the gel composition from the container 1. The bottom 4 of a container 1 is preferably flat to permit easy and complete removal of the last amounts of gel composition from the bottom 4 of the container 1. In practice, the dispensing sheet can be removed from the package once substantially all of the gel composition has been used in order to remove the remaining gel composition in the container.

The container 1 of the present invention is preferably made of a plastic material, although other materials or combinations of materials such as plastic-fiberboard laminate, plastic-foil laminate, or metal such as aluminum, can also be used. The plastic material can be transparent or translucent, or opaque. The transparent or translucent plastic containers can be natural, or can be tinted to any desired color. Similarly, the opaque plastic containers can be of any desired color. The type of plastic and the color of the container selected can depend on the package graphics and text, and on other package aesthetics. Plastic materials used in the construction of these containers can include, but are not limited to, polyethylene, such as low-density or high-density polyethylene, polystyrene, polycarbonate, polypropylene, cellulose acetate, polyester, polyvinyl chloride, and polyvinylidene chloride.

The Dispensing Sheet

The dispensing sheet 8 has a shape that is substantially the same as, and conforms with, the general shape of the container 1, and therefore can be circular, rectangular, or any other shape suitable for the container.

The dispensing sheet 8 is provided with a plurality of interior apertures 9 and 9', and can optionally be provided with a plurality of perimeter apertures 9*a*, 9*b* and 9*d*. When force is applied to the dispensing sheet by either the fingers or a sponge, the gel composition is dispensed up through the aperture(s) nearest to the point where the force is applied. The interior apertures 9 and 9' and perimeter apertures 9*a*, 9*b* and 9*d* can be made in either a uniform or random pattern. A sufficient number of apertures should be distributed across the entire surface of the dispensing sheet to facilitate removal of gel composition.

The shape of an interior aperture 9 and 9' is shown to be circular, although any shape, such as oval, tear drop, or square, is acceptable. The size of an interior aperture 9 and 9' can range, for a circular aperture, from about 1 mm to about 10 mm, more preferably from about 3 mm to about 6 mm, and most preferably from about 4 mm to about 5 mm in diameter. Depending upon the flexibility and resiliency of the dispensing sheet, and upon the viscosity and rheology of the gel, one can easily select the appropriate aperture size, shape, and surface density of apertures for the dispensing sheet (that is, the number of apertures per unit area of dispensing sheet) to practice and achieve the benefits of the invention.

To facilitate removal of gel composition from along the sidewall 2 of the container 1, while maintaining a dispensing sheet which covers substantially the entire surface of the gel (for product waste considerations), it is preferred to use a dispensing sheet 8 having perimeter apertures 9*a*, 9*b* and 9*d*. The shape of perimeter apertures 9*a*, 9*b*, and 9*d* can be any shape, such as a semicircle (9*b*) or a shape (9*c* and 9*d*) which defines petals 13 and 13*d*. The perimeter apertures define all or a portion of the edge 11*a*, 11*b*, and 11*d* of the dispensing sheet. Other alternative shapes for perimeter apertures 9*a* and 9*d* can be selected to define corresponding alternate shapes for petals 13 and 13*d*.

Figure 7:
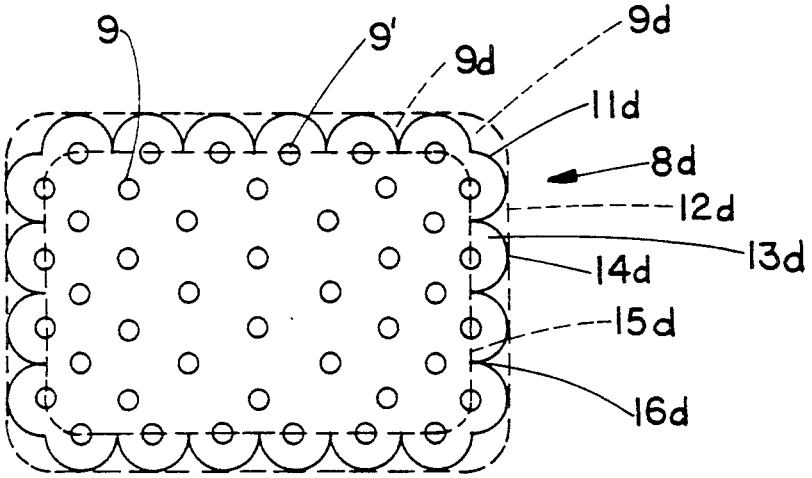
FIG. 7 shows another embodiment of the dispensing sheet of FIG. 5.

The percent open area of the apertures (which includes any perimeter apertures 9*a*, 9*b*, and 9*d* along the edge of the dispensing sheet) relative to the total dispensing sheet area (for example, as defined by imaginary line 12 of FIG. 3 or line 12*d* of FIG. 7) can range from about 2% to about 30%, preferably from about 5% to about 20%, and more preferably than about 10% to about 15%.

Figure 2:
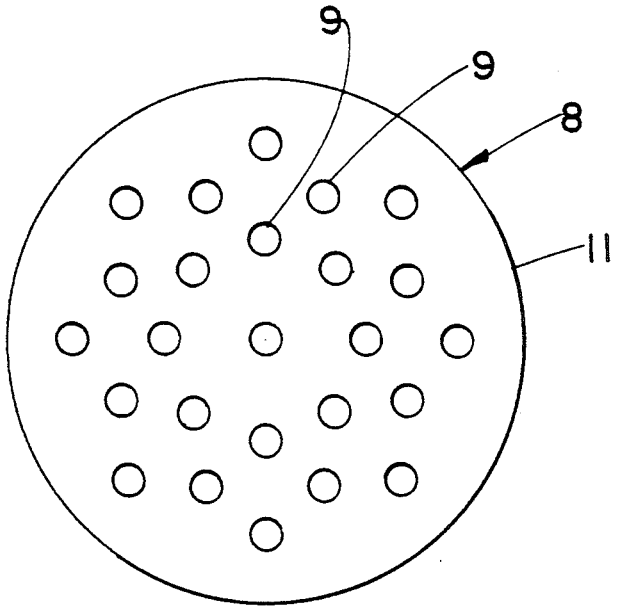
FIG. 2 shows the dispensing sheet of FIG. 1.
Figure 4:
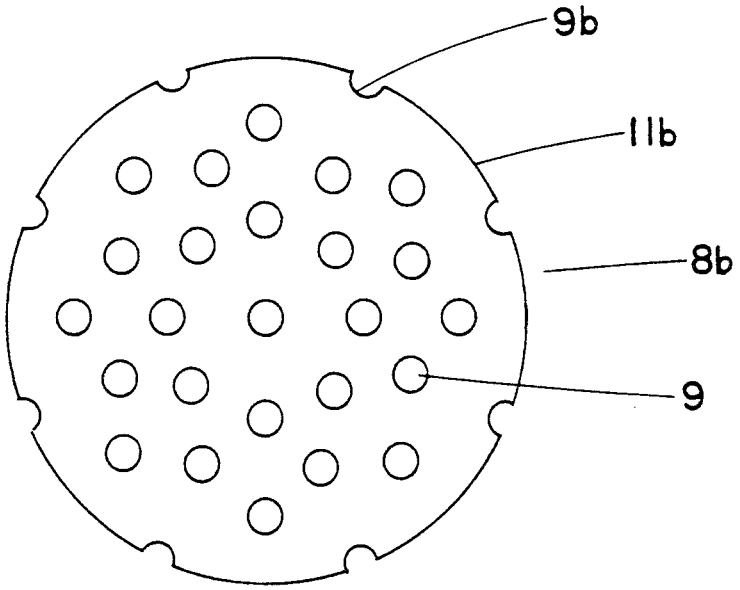
FIG. 4 shows yet another embodiment of the dispensing sheet of FIG. 1.
Figure 6:
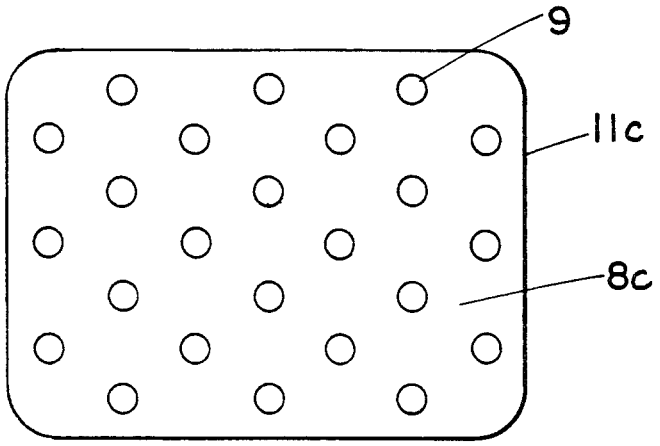
FIG. 6 shows the dispensing sheet of FIG. 5.

The size of the dispensing sheet 8 relative to the size of the opening 3 and/or bottom 4 of the container can be important. When a dispensing sheet 8 or 8*c* such as that disclosed in FIG. 2, FIG. 4 or FIG. 6 (one in which only a portion of the edge is defined by perimeter apertures) is used with a tapered-sidewall container, it is preferred that the diameter or dimensions of the dispensing sheet be (at least) slightly less (about 4–5 mm) than the interior diameter or corresponding dimensions of the bottom 4 of the container. If substantially larger than the diameter or corresponding dimensions of the bottom 4, the dispensing sheet 8 can impinge upon the sidewalls 2, which can prevent the dispensing sheet from descending further, as the gel composition is used. The diameter or dimensions of such a dispensing sheet 8 can be any size which allows it to dispense the gel composition as intended, though preferably it is from about 90% to about 95% the size of the bottom 4. If the diameter or dimensions of the dispensing sheet 8 is too small (for example, smaller than about 80% of the dimension of the bottom 4), the dispensing sheet 8 could move too freely upon the surface 10 of the gel, and could expose a substantial portion of the surface of the gel to the fingers or to the sponge, resulting in excessive usage and waste of the product.

When the sidewalls 2 of the container 1 are substantially vertical (that is, substantially perpendicular to the bottom 4), it is preferred to have a dispensing sheet 8 with a diameter or dimension which is about 4–10 mm less than the diameter or corresponding dimension of the bottom 4, though smaller dispensing sheet dimensions (down to about 80% that of the bottom 4) can be acceptable.

When used in a container 1 having substantially vertical sidewalls 2, a dispensing sheet 8 having perimeter apertures 9*a*, 9*b*, and 9*d* allows the user to more easily remove the gel composition from along the sidewalls 2, whether the container 1 is substantially full or nearly empty. A dispensing sheet 8 with perimeter apertures 9*a*, 9*b* and 9*d* can also be used with a container 1 having tapered sidewalls 2 as described herein.

Figure 3:
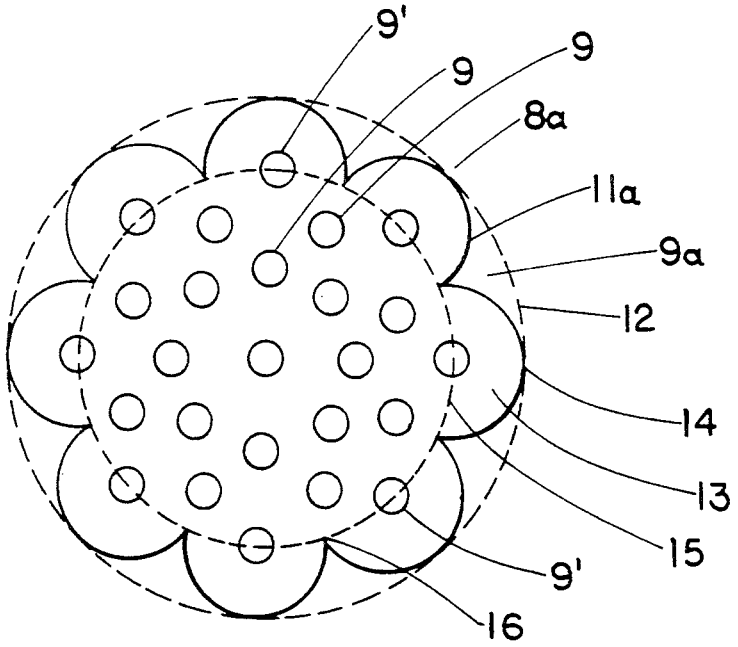
FIG. 3 shows another embodiment of the dispensing sheet of FIG. 1.

A preferred embodiment of the present invention utilizes the dispensing sheet 8*a* shown in FIG. 3 which has petals 13 about its periphery. This sheet design is particularly preferred with a container 1 having tapered sidewalls 2. When the container 1 is substantially full of gel composition (that is, the dispensing sheet 8 is resting upon the surface 10 of the gel composition near the top opening 3 of the container), the diameter of the dispensing sheet shown by the imaginary line 12 in FIG. 3 can be substantially equal to (though preferably about 4–6 mm less than) the diameter of the opening 3 of the container. As gel composition is removed during use from the container, the dispensing sheet 8 will settle downward with the level of gel composition towards the bottom 4 of the container. As the dispensing sheet settles and the tips 14 of petals 13 contact the sidewall 2, the petals 13 of the dispensing sheet 8 will flex upward along an axis generally defined by imaginary line 15. In this embodiment, the imaginary line 15 can have a diameter the same as, though preferably about 4–10 mm or less than, the diameter of the bottom 4 of the container. Thus, when substantially all of the product has been used and the dispensing sheet 8 is resting near the bottom 4 of the container, the petals 13 will have flexed upwardly and will lie at least partially against the inner side of sidewall 2 of the container. Removal of gel from the corners of the bottom 4 of the container can be further facilitated by providing apertures 9' along the imaginary line 15 which corresponds substantially with the edge of the bottom of the container. Alternatively, the dispensing sheet 8 can be removed from the package once substantially all of the gel composition has been used in order to remove the remaining gel composition in the container. The petals 13 can serve as a convenient structure to grasp and remove the dispensing sheet.

The petal design according to the above description can also be applied to a rectangular-shaped dispensing sheets 8*d*, or to a dispensing sheet of any other shape, with substantially the same results.

The dispensing sheet 8 can be transparent, and can also be translucent or opaque. It can be constructed of plastic or of alternative materials (such as those disclosed hereinbefore for the container 1) which are resilient and flexible, and are resistant to the product. The dispensing sheet 8 can be constructed from a sheet or film of material, and can have a thickness of from about 0.1 mm to about 3 mm, preferably from about 0.5 mm to about 2 mm and more preferably about 1 mm. The thickness, however, of the dispensing sheet 8 can also be selected based on the resiliency, strength, and flexibility of the material. Flexibility, strength, and resiliency are important requirements of the dispensing sheet 8. The dispensing sheet 8 must be able to flex in response to force applied by the fingers or sponge, and must be able to bend and conform to the surface 10 of the gel composition in response to adhesive forces between the gel composition and the dispensing sheet. When downward force is applied to the dispensing sheet 8, gel composition is dispensed up through the apertures in the vicinity of the downward force, while at the same time a substantially equal and opposite force is exerted by the gel composition upwardly against the dispensing sheet outside the vicinity of downward force. Since the dispensing sheet 8 will flex in response to, rather than resist, these opposing forces, the force needed to dispense gel composition through the apertures is minimized.

At the same time, the dispensing sheet 8 must have sufficient strength to prevent the fingers or sponge from perforating the dispensing sheet, and sufficient resiliency to resist the force of the fingers from bending and folding over the dispensing sheet and submerging it into the gel composition, and to enable the dispensing sheet to maintain its shape despite the adhesive forces of the gel composition and the upward forces of the gel composition in response to force from the fingers. A sheet material with high flexibility and low resiliency could be overcome by the forces of adhesion and could ball-up easily in the gel. On the other hand, a sheet material with high resiliency and little or no flexibility will require excessive force to expel gel through the apertures since the sheet will face considerable resistance from the incompressible gel composition uniformly across the entire area of the dispensing sheet.

The Gel Composition

Generally, any viscous or semisolid gel, paste, cream and lotion composition is suitable for use in the dispensing package of the present invention. The composition should not be, or become, a liquid at any ordinary use temperature such that the dispensing sheet might submerge into the composition when force is applied, and should not be so thick or viscous that excessive force or excessively large apertures are needed to dispense the composition.

Cleaning compositions in gel form for hard surface cleaning and dishwashing are quite common and have been described extensively in the literature. Non-limiting examples of such gels are described in the following references, all of which are incorporated herein by reference: Great Britain Patent No. 1,370,377, published (a detergent gel for hard-surface cleaning containing an anionic surfactant, polyhydric alcohol, an inorganic salt and a dispersing agent); Canadian Patent No. 1,070,590, published (a translucent stable single-phase gel containing alkyl ether sulfate, potassium pyrophosphate, water and solvent); and U.S. Pat. No. 4,615,819, issued (a detergent composition comprising stable hexagonal phase gels containing a "secondary" anionic or cationic surfactant, an additive capable of forcing the surfactant into hexagonal phase, optional builders and other adjuvants, and water).

Other compositions which can be packed into and dispensed from the dispensing package of the present invention includes paste cleaners for hard surface cleaning. Non-limiting examples of such paste compositions are described in the following references, all of which are incorporated herein by reference: U.S. Pat. No. 3,981,826, issued Sept. 21, 1976 (a non-aqueous liquid, pasty or gelatinous detergent composition comprising a dispersion of a polyhydric alcohol, a surfactant, an abrasive, and a highly voluminous oxide suspending agent); European Patent 0,269,178, published June 1, 1988 (an aqueous, viscous, creamy scouring cleanser containing a surfactant, an abrasive, a thickening agent, and an organic solvent comprising saturated terpene); and U.S. Pat. No. 4,005,027 issued Jan. 25, 1977 (stable, fluid, aqueous hard-surface scouring cleanser containing bleach, clay, abrasive, surfactant, andbuffer).

Still other compositions include lotions and creams for facial cleansing and skin care. Non-limiting examples of such lotion and cream compositions are described in the following references, all of which are incorporated herein by reference: European Patent 0,282,127, published Sept. 14, 1988 (skin conditioning and cleansing compositions containing propoxylated glycerol derivatives); U.S. Pat. No. 4,370,319, issued Jan. 25, 1983 (an aqueous skin conditioning compositions comprising an alkali metal phosphoric acid ester sale of a partial glyceride, silicone fluid, an alkyl ester of fatty acid, an emollient material, and an emulsifier); U.S. Pat. No. 4,634,719, issued Jan. 6, 1987 (cold cream comprising water, oil, and an alpha-mono (methyl-branched alkyl)glycerol ether surfactant); and U.S. Pat. No. 4,726,915, issued Feb. 23, 1988 (cleansing composition comprising at least one anionic sulfated polyoxyalkylene surfactant and at least one amphoteric surfactant).

The present invention is particularly useful in the packaging and dispensing of gel dishwashing compositions such as these disclosed in the references hereinbefore described. In general, these gels compositions comprise a suitabledetergent surfactant, preferably an anionic detergent surfactant, water, and optional adjuvants such as auxiliary surfactants, surfactant additives, builders, dyes, perfumes, abrasives, and fillers.

The Container Lid

A container lid 6 can optionally be used with the package. The can be made of the same material as, or of a material different from, the container 1. The lid 6 is constructed to be either removable from or hinged to the container 1 to cover and uncover the opening 3, and to fit firmly and securely over the rim 5 of the container 1. The specific design of the lid 6 and its means of attachment to the container 1 are not critical to the present invention, so long as the lid 6 fits securely when in place to prevent unnecessary spillage, and so long as the lid 6 is not too difficult to remove when the product is intended to be used.

A Sponge

The dispensing package of the present invention can optionally include an implement such as a sponge which is placed on top of the dispensing sheet 8. The dispensing sheet acts as a barrier in this case between the gel and the sponge, and keeps the sponge from becoming messy both as packaged as well as during use.

What is claimed is:

1. A dispensing package for viscous and semi-solid compositions, comprising:

(a) a container for said composition comprising a bottom and sidewalls and provided with an opening, wherein said sidewalls of said container are tapered so that the dimensions of said opening of said container are larger than the corresponding dimensions of said bottom of said container; and (b) a dispensing sheet made of a flexible, resilient material, said dispensing sheet having an edge and being provided with a plurality of apertures;

wherein said dispensing sheet rests upon and adheres to the surface of a viscous or semi-solid composition contained in said container, wherein the composition is selected from the group consisting of gels, pastes, creams, lotions, and mixtures thereof, and wherein the shape of said dispensing sheet is substantially the same as the shape of said container.

2. A dispensing package according to claim 1 wherein said dispensing sheet is provided with a plurality of perimeter apertures which define a portion of said edge of said dispensing sheet, and wherein the portion of said edge as defined by said perimeter apertures consists of a plurality of petals.

3. A dispensing package according to claim 2 wherein the dimensions of a shape bordered by an imaginary line drawn around the outer tips of the petals is: (a) equal to or less than the dimensions of the opening of the container, and (b) equal to or greater than the dimensions of the bottom of the container, and wherein the dimensions of a shape bordered by an imaginary line drawn between the inner edges of adjacent petals is equal to or less than the dimensions of the bottom of the container.

4. A dispensing package according to claim 1 wherein said composition is a gel dishwashing composition.

5. A dispensing package according to claim 1 further provided with a lid releasably secured across said opening of said container.

* * * * *